United States Patent [19]

Machida et al.

[11] Patent Number: 4,862,862

[45] Date of Patent: Sep. 5, 1989

[54] ENGINE IGNITION CONTROL DEVICE

[75] Inventors: Hisashi Machida; Tetsuo Iri; Nobuyuki Terakawa, all of Saitama, Japan

[73] Assignee: Honda Giken Kogyo Kabushiki Kaisha, Tokyo, Japan

[21] Appl. No.: 141,981

[22] Filed: Jan. 11, 1988

[30] Foreign Application Priority Data

Sep. 14, 1987 [JP] Japan ..... 62-230240

[51] Int. Cl.[4] ..... F02P 5/04

[52] U.S. Cl. ..... 123/609; 123/617

[58] Field of Search ..... 123/609, 610, 611, 612, 123/614, 617

[56] References Cited

U.S. PATENT DOCUMENTS

| | | | |
|---|---|---|---|
| 4,167,927 | 9/1979 | Mikami et al. | 123/609 |
| 4,170,209 | 10/1979 | Petrie et al. | 123/609 |
| 4,276,800 | 7/1981 | Capurka | 123/609 |
| 4,367,710 | 1/1983 | Deheris | 123/609 |
| 4,442,822 | 4/1984 | Kondo et al. | 123/617 |
| 4,457,286 | 7/1984 | Katayama et al. | 123/617 |
| 4,741,319 | 5/1988 | Narita et al. | 123/609 |

*Primary Examiner*—Raymond A. Nelli

*Attorney, Agent, or Firm*—Lyon & Lyon

[57] ABSTRACT

There is disclosed an engine ignition control device including a control switch element arranged, in its ON state, to pass a current through a primary side of an ignition coil and, in its OFF state, to break the current passing through the primary side of the ignition coil, thereby inducing a high voltage across a secondary side of the ignition coil to cause an ignition of an engine.

4 Claims, 4 Drawing Sheets

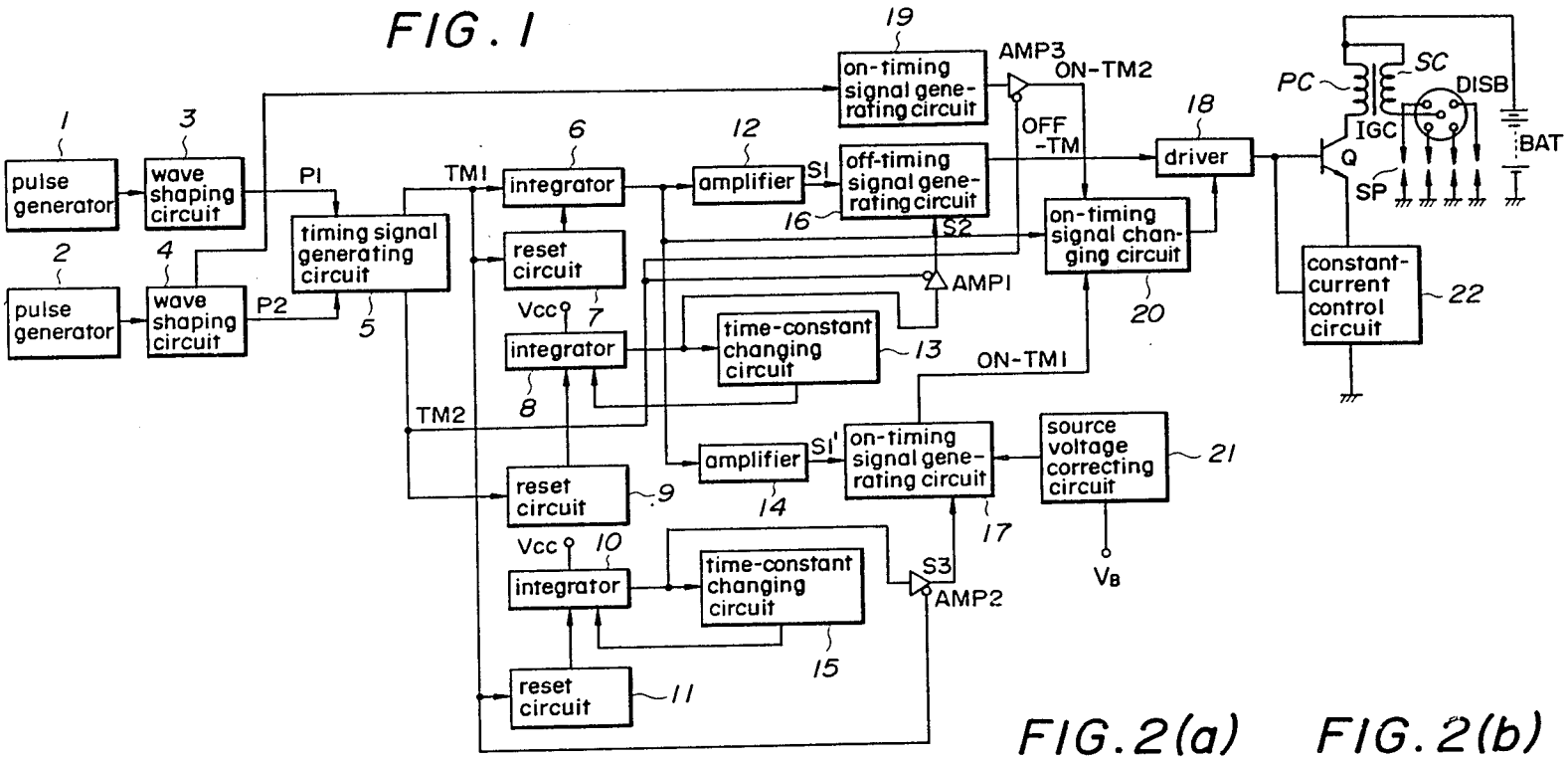
FIG. 1
pulse generator
wave shaping circuit
P1
P2
timing signal generating circuit
TM1
TM2
integrator
reset circuit
Vcc
amplifier
S1
S1'
S2
S3
AMP1
AMP2
AMP3
on-timing signal generating circuit
off-timing signal generating circuit
time-constant changing circuit
ON-TM1
ON-TM2
OFF-TM
on-timing signal changing circuit
driver
source voltage correcting circuit
$V_B$
constant-current control circuit
PC
IGC
SC
DISB
SP
BAT

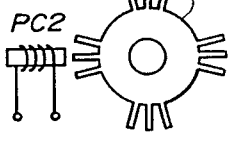
FIG. 2(b)
RE2
PC2

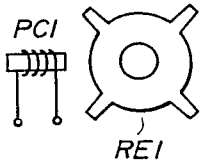
FIG. 2(a)
RE1
PC1

ENGINE IGNITION CONTROL DEVICE

BACKGROUND OF THE INVENTION

1. Field of the Invention

The present invention relates to an electronic engine ignition control device for automatically controlling an engine ignition to an optimum state in response to an engine speed.

2. Description of the Prior Art

Heretofore, in order to effect an adjustment of a spark-advance angle of an engine at its ignition time and an ON-OFF duty control of a switching power transistor arranged in a primary side of an ignition coil in response to an engine speed, an engine ignition control device of two-pulse system, as shown in FIG. 7, has been proposed, which includes means for generating two reference pulse signals Pa and Pb which are synchronized with the rotation of the engine and which vary their phase difference in response to the engine speed, means for generating a first signal Sa formed by producing a triangular wave signal at the timing of said reference pulse signal Pa and holding its peak value, means for generating a second signal Sb formed by producing a triangular wave signal at the timing of said reference pulse signal Sb and holding its peak value, and means for comparing one of the signals Sa or Sb with the other one of the signals Sb or Sa which has been added with a pretermined bias and clamped, thereby obtaining crossing points a and b of the peak value of one of the triangular wave signals and a leading edge portion of the other trianglar wave signal, said points a and b forming OFF and ON time points of said power transistor, respectively. (See Japanese patent publication No. 57631/1983 and No. 60987/1986).

In the conventional engine ignition control device of two pulse system, as described above, a level of the signal which holds the peak value of the triangular wave signal varies in accordance with variation of the engine speed, but in the case of the leading edge portion of the triangular wave signal which does not hold its level owing to its characteristics, it cannot be used as a threshold value to be compared with the other triangular wave signal. Accordingly, the duty control range as well as the spark-advance angle range are narrowered and even if a satisfactory ignition control can be attained in case of an engine of a two-wheel vehicle, a satisfactory ignition characteristic cannot be attained in case of a four-wheel vehicle or the like where duty control is required to obtain delicate spark-advance control and high ignition energy enough to meet the regulation of exhaust gas. In FIG. 4, T1 indicates a duty control range in one ignition cycle T and T2 indicates a speak-advance range in the one ignition cycle.

In case of the conventional engine ignition control device of two pulse system as described above, a particular spark-advance characteristics which depends upon a phase difference $\theta$ between the two reference pulse signals Pa and Pb, as shown is FIG. 8, only makes a linear change within an engine speed range $\Delta N$ determined by circuit constants, so that it is impossible to freely obtain an optimum spark-advance characteristic at the time of ignition as required by the engine.

OBJECT OF THE INVENTION

In view of the above, it is an object of the present invention to provide an engine ignition control device for effecting an adjustment of a spark-advance angle of an engine at its ignition time and an ON-OFF duty control of a switching power transistor arranged in a primary side of an ignition coil in response to an engine speed, which effect a proper and delicate control of the spark-advance angle in accodance with an engine speed, with a wide control range from a lower engine speed to a higher engine speed and to effect an optimum duty control while suppressing useless heat generation of the ignition coil and assuring ignition energy as required.

SUMMARY OF THE INVENTION

In order to attain the object as described above, in accordance with the present invention, there is provided an engine ignition control device including a control switch element arranged, in its ON state, to pass a current through a primary side of an ignition coil and, in its OFF state, to break the current passing through the primary side of the ignition coil, thereby inducing a high voltage across a secondary side of the ignition coil to cause an ignition of an engine, characterized in that said device comprises pulse generating means for successively generating three pulse signals per one cylinder of the engine during every one rotation thereof in synchronized relation to the rotation of the engine, first integrating means arranged to start its integrating operation at a second pulse signal in the train of pulse signals and to stop its integrating operation at a third pulse signals of said train of pulse signals and hold its integrated value until a next operating cycle, second integrating means arranged to start its integrating operation at a first pulse signal of said train of pulse signals and to reset at the third pulse signal, third integrating means arranged to start its integrating operation at the third pulse signal of said train of pulse signals and to reset at a second pulse position of the next operating cycle, OFF-timing setting means arranged to turn OFF said control switch element at a crossing position of output wave forms corresponding to a predetermined multiple of the waveform of an output of the first integrating means and a wave form of an output of the second integrating means and ON-timing setting means arranged to turn ON said control switch element at a crossing position of wave forms corresponding to a predetermined multiple of an output of the first integrating means and a wave form of an output of the third integrating means.

Further in accordance with the present invention the second integrating means has an integrating time constant which is changed over halfway to provide a rising spark-advance characteristic which becomes less steep halfway shape.

Further in accordance with the present invention the device may include second ON-timing setting means arranged to turn ON said control switch element at a predetermined level of said pulse signal and means for detecting whether or not the engine is in low speed state where the engine speed is lower than a predetermined speed, in which the ON-timing setting means responding to the integrated output is changed over to the second ON-timing setting means when the low speed state is detected so that an optimum duty control can be effected even in the low engine speed state.

BRIEF DESCRIPTION OF THE DRAWINGS

FIG. 1 is a block diagram showing the construction of an embodiment of the engine ignition control device according to the present invention.

FIG. 2(*a*) and FIG. 2(*b*) illustrate examples of construction of first and second pulse generators in the embodiment as shown in FIG. 1.

DESCRIPTION OF THE PREFERRED EMBODIMENT

Figure 3:
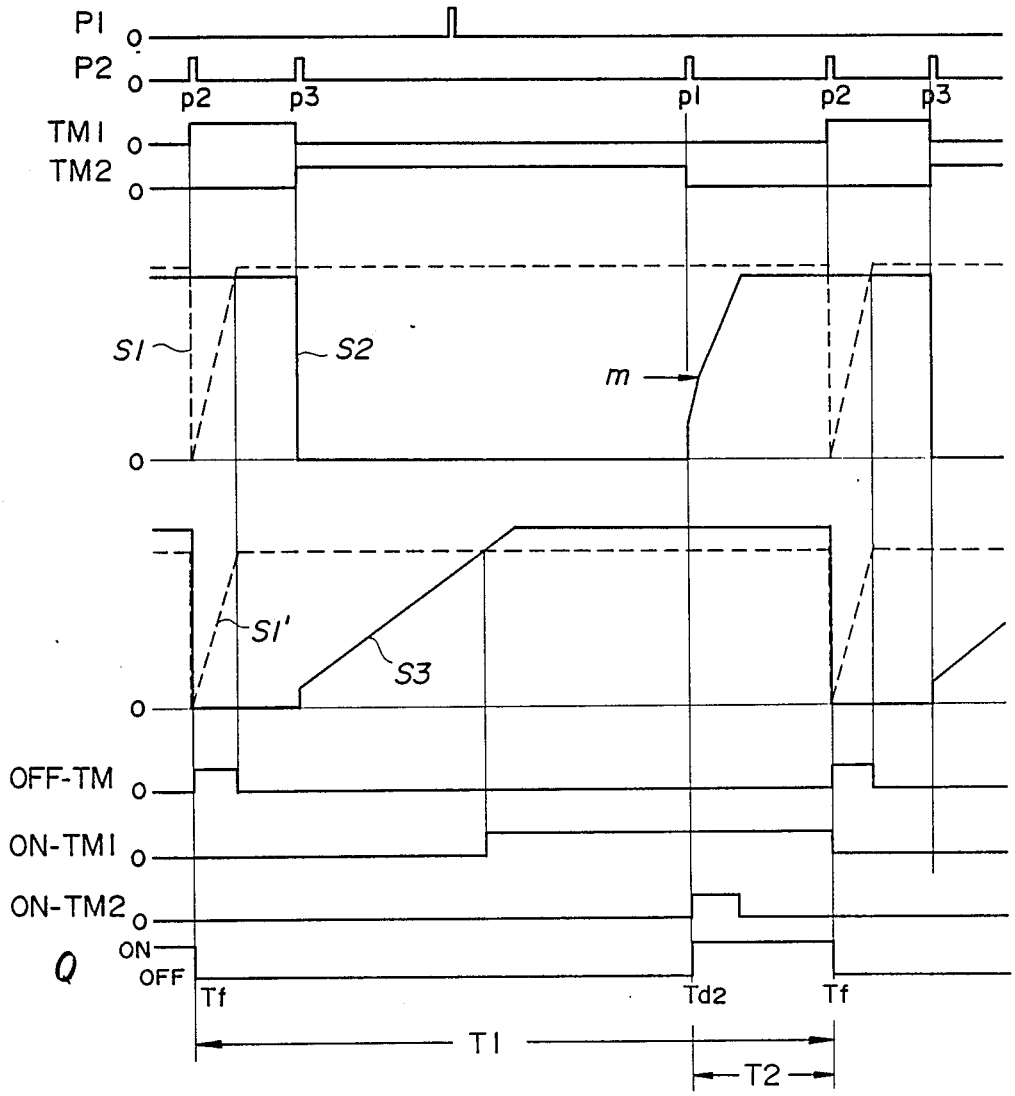
FIGS. 3–5 are time charts showing signals at various parts in the above embodiment, the respective figures showing different engine speed states.

Now the invention will be described with reference to the drawings which illustrate an embodiment of the present invention.

The engine ignition control device according to the present invention, as shown in FIG. 1, includes a switching power transistor Q which is arranged, in its ON state, to pass a current through a primary coil PC of an ignition coil IGC of an engine and, in its OFF state, to break the current passing through the primary coil PC, thereby inducing a high voltage across a secondary coil SC of the ignition coil. The high voltage thus produced is applied to a distributor DISB arranged at the side of the secondary coil SC, which acts to successively cause sparks of respective ignition plug SP, thereby igniting the engine. (In this case, reference is made to a four-cylinder engine.)

The device according to the present includes a first pulse generator 1, arranged to generate the same number of pulse signals as that of cylinders of the engine during every one rotation in synchronized relation to the rotation of the engine; a second pulse generator 2 arranged in the same manner as that of the first pulse generator to successively generate three pulse signals per one cylinder, depending upon the number of the cylinders, during every one rotation of the engine in synchronized relation to the rotation of the engine; wave shaping circuits 3 and 4 for shaping output waves of the pulse generators 1 and 2 respectively; a timing signal generating circuit 5 arranged to be reset by a first pulse signal P1, which has been shaped by the wave shaping circuit 3, and generates predetermined timing signals TM1 and TM2 on the basis of a second pulse signal P2 consisting of a series of three pulses which have been shaped by the wave shaping circuit 4; a first integrator 6 arranged to reset (discharge) in accordance with an output of a reset circuit 7 which is triggered depending upon one of the timing signals TM1 and to effect a predetermined integrating operation by constant current charging; a second integrator 8 arranged to reset (discharge) in accordance with an output of a reset circuit 9 which is triggered depending upon the other timing signal TM2 and to effect a predetermined integrating operation by constant current charging; a third integrator 10 arranged to reset (discharge) in accordance with an output of a reset circuit 11 which is triggered depending upon the one timing signal TM1 and to effect a predetermined integrating operation by constant current charging; a time-constant changing circuit arranged to change over an integrating time-constant of the second integrator 8 at a point of time when it has been charged to a predetermined level during integrating operation by constant current charging, thereby producing a rising characteristic in the form of a noncontinuous, multi-sloped line; a time-constant changing circuit 15 arranged to change over an integrating time-constant of the third integrator 10 at a point of time when it has been charged to a predetermined level during the integrating operation by constant current charging, thereby producing a rising characteristic in the form of a noncontinuous, multi-sloped line; an OFF-timing signal generating circuit (comparator) 16 arranged to compare a signal S1, which has been obtained by amplifying an output of the first integrator 6 to a predetermined multiple thereof, by means of an amplifier 12, and a signal S2, which has been obtained by amplifying an output of the second integrator 8 by means of an amplifier AMP1 having a switching function, and to apply an OFF-timing signal OFF-TM to a driver 18 for said power transistor Q when $S1 \leqq 2$, where both signal wave forms cross each other; and a first ON-timing signal generating circuit (comparator) 17 arranged to compare signal S1′, which has been obtained by amplifying the output of the first integrator 6 to a predetermined multiple thereof by means of an amplifier 14, and a signal S3, which has been obtained by amplifying an output of the third integrator 10 by means of an amplifier AMP2 having a switching function, and to apply an ON-timing signal ON-TM1 through an ON-timing changing circuit 20 (to be hereinafter described) to the above mentioned driver 18 when $S1' \leqq S3$, where both signal wave forms cross each other.

The construction as shown in FIG. 1 further includes a second ON-timing signal generating circuit 19 arranged to turn ON and OFF its output in accordance with a first pulse in the second pulse signal P2, which has been shaped by the wave shaping circuit 4, to generate a second ON-timing signal ON-TM2 (see FIG. 3); and the ON-timing changing circuit 20 arranged to detect whether or not the engine speed is lower than a preset low engine speed (for example, 600 rpm), by discriminating an output voltage of the first integrator 6 at a predetermined voltage level and to change over the ON-timing signal applied to the driver 18 for the power transistor Q to the second ON-timing signal ON-TM2 when the low engine speed has been detected. In the usual engine speed range, which is higher than said low engine speed, the first ON-timing signal ON-TM1 is applied through the ON-timing changing circuit 20 to said driver 18.

A source voltage correcting circuit 21 is provided to correct a source voltage by adding a voltage value obtained by dividing a battery voltage VB, which forms a voltage source for the ignition device, to the output side of the third integrator 10 in the first ON-timing signal generating circuit 17. For example, the correction is made by increasing the ON time of the power transistor Q, that is the current passing time of the primary coil PC, by 8% at every 1V lowering of the battery voltage VB.

A constant current control circuit 22 is arranged at the side of the power transistor Q to stabilize switching operation.

The first pulse generator consists of a reluctor RE1 and a pickup coil PC, as shown in FIG. 2 (*a*), which are arranged to generate one pulse signal per one cylinder during one rotation. In this case, the engine is assumed to be a four cylinder engine.

The second pulse generator 2 consists of a reluctor RE2 and a pickup coil PC2, as shown in FIG. 2(6), which are arranged to successively generate a pulse signal including three pulses per one cylinder during one rotation.

The above-mentioned timing signal generating circuit 5 operates, on the basis of the second pulse signal P2, to generate the turning signal TM1, which is at high level during a P2 position of its second pulse and a P3 position of its third pulse, and the timing signal TM2, which is at high level during a P3 position of its third pulse and a P1 position of a first pulse in a next cycle.

The first and second pulse generators 1 and 2 are arranged in such relation that the first pulse signal P1 is produced in suitable timing between the third pulse P3 and the first pulse in the next cycle of the second pulse signal P2.

The first integrator 6 is constructed to effect the following integrating operation. Depending upon the timing signal TM1, the first integrator 6 starts the integrating operation by constant current charging at the position of the second pulse P2 in the second pulse signal P2 and it stops the integrating operation at the position of the third pulse P3 and holds its integrated value until the next cycle, as shown in the characteristic diagram of the signal S1 in FIGS. 3–5.

The second integrator 8 is constructed to effect the following integrating operation. Depending upon the timing signed TM2, the second integrator 8 starts the integrating operation by constant current charging at the position of the first pulse P1 in the second pulse signal P2 and it resets (discharges) at the position of the third pulse P3, as shown in the characteristic diagram of the signal S1 in FIGS. 3–5.

The third integrator 10 is constructed to effect the following integrating operation. Depending upon the timing signed TM1, the third integration 10 starts the integrating operation by constant current charging at the position of the third pulse P3 in the second pulse signal P2 and resets (discharges) at the position of the second pulse P2 in the next cycle, as shown in the characteristic diagram of the signal S in FIGS. 3–5.

In the above construction, comparison is effected between the signal S1 and the signal S2 in the OFF-timing signal generating circuit 16 and an OFF-timing signal OFF-TM is produced when $S1 \leqq S2$ where both signal forms cross each other. The OFF-timing signal OFF-TM thus produced is applied to the driver 18, and switching power transistor Q is turned off at the point of time Tf where the OFF-timing signal OFF-TM rises to its high level under the control of the driver 18, whereby current passing through the primary coil of the ignition coil IGC is broken, so that the engine is ignited as described above.

In the integrating operation by constant current charging effected in the second integrator 8, the integrating time-constant is changed over to a larger value by the time-constant changing circuit 13 at the point of time when the charging has been made to a predetermined level (point m shown in FIGS. 3–5) and the rising characteristic of the wave form of the signal S2 becomes moderate from the point m.

Figure 4:
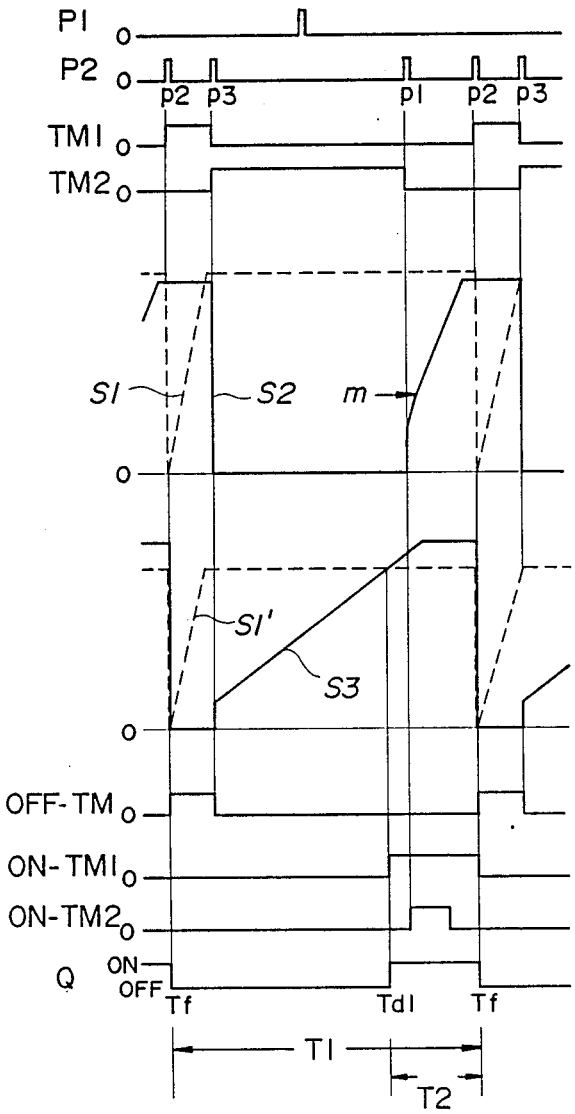
Figure 5:
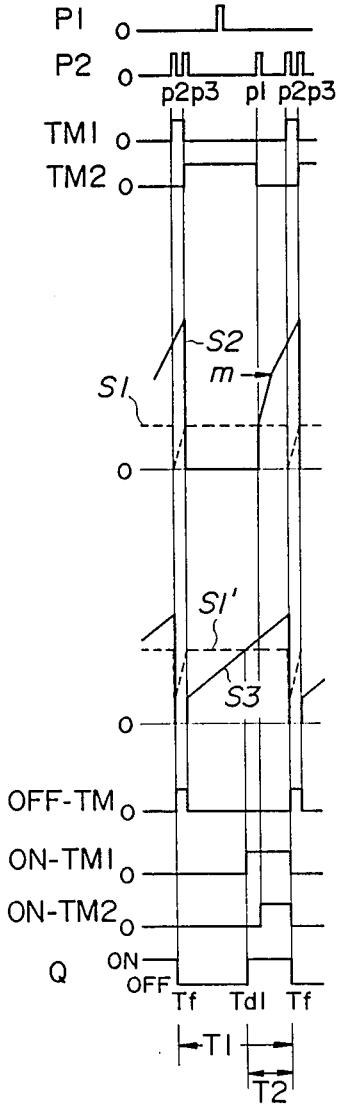

Accordingly, when the engine is ignited at the point Tf where the signal S1 and the signal S2 cross each other, the crossing point Tf is produced in the steep rising position before it reaches the point m of predetermined level, as shown in FIG. 5, or it is produced in the moderate rising portion after it has reached the point m, as shown in FIG. 4, depending upon the engine speed. Thus it is possible to effect the delicate control of spark-advance, depending upon the engine speed.

Figure 6:
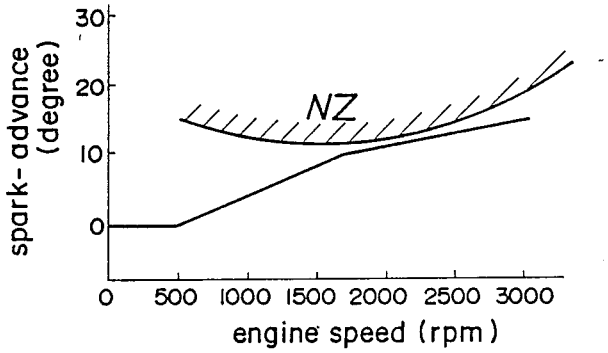
FIG. 6 is a diagram showing a spark-advance vs engine speed characteristic.
Figure 7:
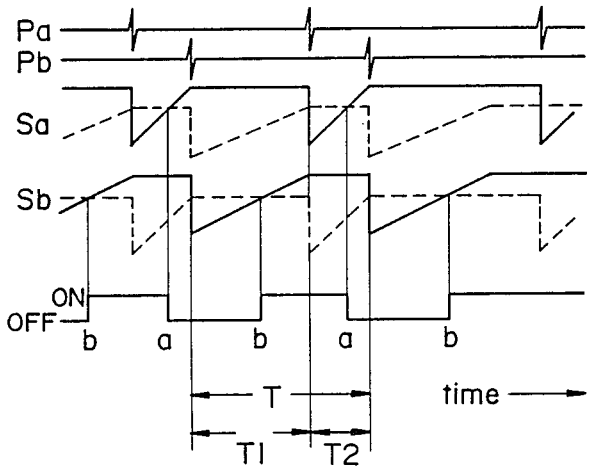
FIG. 7 is a time chart showing signals at several parts of the conventional engine ignition control device of two pulse system.
Figure 8:
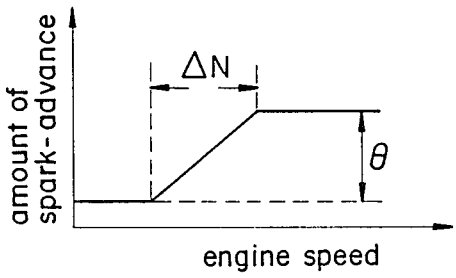
FIG. 8 is a diagram showing a spark-advance vs engine speed characteristic of the conventional engine ignition control device.

FIG. 6 shows the characteristic of the spark-advance relative to the engine speed.

By producing the spark-advance characteristic in a rising, noncontinuous, multi-sloped line shape, as shown in FIG. 6, it is possible to set the ignition timing of the engine more advanced, while avoiding knocking zone NZ, so that a torque characteristic of an engine is improved and higher power as well as economy in fuel consumption can be obtained.

In the case where the output of the second integrator 8 is of non-linear shape so that the spark-advance characteristic is of a rising, noncontinuous, multi-sloped processing is required to make the output of the third integrator 10 also a non-linear shape by the time-constant changing circuit 15, in order to hold the current passing time of the ignition coil IGC at a constant value over a wide rotation range. However the time-constant changing circuit 15 may be omitted if the ignition coil IGC has sufficient heat-generating characteristic.

The ON-timing signal generating circuit 17 operates to compare the signal S1′ and the signal S3, thereby producing an ON-timing signal ON-TM1 which is at high level when $S1' \leqq S3$, where both waves cross each other as shown in FIGS. 3–5. In the usual engine rotation range, the ON-timing signal ON-TM1 is selected in the ON-timing changing circuit 20 and applied to the driver 18 and the switching power transistor Q is turned ON at the point of time Td 1 where the ON-timing signal ON-TM1 rises to a high level under the control of the driver 18, whereby a current is passed through the primary side of the ignition coil IGC.

In the low engine speed rotation range where the engine speed is lower than a predetermined value, a second ON-timing signal ON-TM2 fed from the ON-timing signal generating circuit 19 is selected by the ON-timing changing circuit 20 and applied to the driver 18, and in this case the switching power transistor Q is turned ON at the point of time Td 2 where the ON-timing signal ON-TM2 rises to a high level under the control of the driver 18, whereby a current is fed to the primary side of the ignition coil IGC. Accordingly, even at the time of the low speed rotation of the engine the duty control is effected for the proper current passing time.

FIG. 3 illustrates the signal characteristic at several parts in the low speed range when the engine speed is 400 rpm. FIG. 4 and 5 illustrate the signal characteristics at several parts in the usual speed range when the engine speed is 800 rpm and 1600 rpm, respectively.

Thus, according to the present invention the positions of the integrating operation of the first to third integrators 6, 8 and 10 can be set, as desired, by setting the position of the three pulses P1, P2 and P3 in the second pulse signal S2.

Accordingly, the gradient of the rise of the wave from in the third integrator 10 can be set, as desired, whereby the ON-timing of the power transistor Q can be determined, without being subjected to any effect of the spark-advance characteristic, so that the duty control range T1 becomes one ignition cycle at maximum as shown in FIGS. 3–5, pending upon the engine speed. Thus the ignition of the engine can be effected with an optimum igniting energy, depending upon the engine rotation, by turning ON the switching power transistor Q, which serves to connect or disconnect the primary current of the ignition coil IGC, at any timing in the one ignition cycle.

The gradient of the rise of the wave form in the second integrator 8 can be set as desired, whereby the spark-advance range T2 in the one ignition cycle can be selected over a wide range which could not be obtained in the conventional device, so that the delicate and optimum control of the spark-advance can be obtained, depending upon the engine speed, throughout the low speed range and the high speed range.

Thus it will be understood that the present invention provides an engine ignition control device of three pulse control system in which the duty control and the spark-advance control are effected in accordance with the three pulses of the second pulse signal P2. According to the present invention, it is possible to effect delicate control of the spark-advance, depending upon the engine rotation speed, with satisfactory control range, throughout the low speed range and the high speed range and optimum duty control, while suppressing the useless heat generation of the ignition coil and assuring the required ignition energy.

We claim:

1. In an ignition control device for an engine including a control switch element arranged, in its ON state, to pass a current through a primary side of an ignition coil and, in its OFF state, to break the current passing through the primary side of the ignition coil, thereby inducing a high voltage across a secondary side of the ignition coil to cause an ignition of the engine, the construction comprising:

pulse generating means for generating a pulse train signal including three pulse signals per one cylinder of the engine during every one rotation thereof in synchronized relation to the rotation of the engine;

first integrating means arranged to start its integrating operation by constant-current charge in response to a second pulse signal in the pulse train signal and to stop said integrating operation in response to a third pulse signal in the pulse train signal and hold its integrated value until a next operating cycle;

second integrating means arranged to start its integrating operation by constant-current charge in response to a first pulse signal in said pulse train signal and to reset in response to the third pulse signal;

third integrating means arranged to start its integrating operation by constant-current charge in response to the third pulse signal in said pulse train signal and to reset in response to a second pulse signal of the next operating cycle;

OFF-timing signal generating means arranged to compare a signal obtained by multiplying an output of the first integrating means by a constant number with a signal obtained by amplifying an output of said second integrating means at a predetermined amplification factor and to generate an OFF-timing signal at a crossing point of these signals;

ON-timing signal generating means arranged to compare the signal obtained by multiplying the output of the first integrating means by the constant number with a signal obtained by amplifying an output of the third integrating means at a predetermined amplification factor and to generate an ON-timing signal at a crossing point of these signals; and driver means arranged to turn ON said control switch element in response to said ON-timing signal and to turn OFF said control switch element in response to said OFF-timing signal.

2. The construction according to claim 1, including time-constant change-over means which is arranged to change-over an integrating time constant of the second integrating means halfway during its integrating operation to a larger value, to produce a rise characteristic of the output of the second integrating means which becomes less steep halfway, which provides a rising ignition advance characteristic which becomes less steep above a predetermined engine speed.

3. In an ignition control device for an engine including a control switch element arranged, in its ON state, to pass a current through a primary side of an ignition coil and, in its OFF state, to break the current passing through the primary side of the ignition coil, thereby inducing a high voltage across a secondary side of the ignition coil to cause an ignition of the engine, the construction comprising:

pulse generating means for generating a pulse train signal including three pulse signals per one cylinder of the engine during every one rotation thereof in synchronized relation to the rotation of the engine;

first integrating means arranged to start its integrating operation by constant-current charge in response to a second pulse signal in the pulse train signal and to stop said integrating operation in response to a third pulse signal in the pulse train signal and hold its integrated value until a next operating cycle;

second integrating means arranged to start its integrating operation by constant-current charge in response to a first pulse signal in said pulse train signal and to reset in response to the third pulse signal;

third integrating means arranged to start its integrating operation by constant-current charge in response to the third pulse signal in said pulse train signal and to reset in response to a second pulse signal of the next operating cycle;

OFF-timing signal generating means arranged to compare a signal obtained by multiplying an output of the first integrating means by a constant number with a signal obtained by amplifying an output of said second integrating means at a predetermined amplification factor and to generate an OFF-timing signal at a crossing point of these signals;

first ON-timing signal generating means arranged to compare the signal obtained by multiplying the output of the first integrating means by the constant number with a signal obtained by amplifying an output of the third integrating means at a predetermined amplification factor and to generate a first ON-timing signal at a crossing point of these signals;

second ON-timing signal generating means arranged to generate a second ON-timing signal in synchronized relation to the first pulse signal on said pulse train signal;

ON-timing signal change-over means arranged to detect whether or not the engine is in low-speed rotating state where the number of rotations of the engine is lower than a predetermined value and to effect change-over from the first ON-timing signal to the second ON-timing signal when the low-speed rotating state has been detected; and driver means arranged to turn ON said control switch element in response to the first or second timing signal changed over by the ON-timing signal change-over means and to turn OFF said control switch means in response to said OFF-timing signal.

4. The construction according to claim 3 including time-constant change-over means which is arranged to change over an integrating time constant of the second integrating means halfway of its integrating operation to a larger value, to produce a rise characteristic of the output of the second integrating means which becomes less steep halfway, which produces a rising ignition advance characteristic which becomes less steep above a predetermined engine speed.

* * * * *

UNITED STATES PATENT AND TRADEMARK OFFICE

CERTIFICATE OF CORRECTION

PATENT NO. : 4,862,862

DATED : September 5, 1989

INVENTOR(S) : Hisashi Machida et al

It is certified that error appears in the above-identified patent and that said Letters Patent is hereby corrected as shown below:

On the title page, item [73]:
Please correct the name of the Assignee, change "Honda Giken Kogyo Kabushiki Kaisha" to --Toyo Denso Kabushiki Kaisha--.

Signed and Sealed this

Fourteenth Day of May, 1991

*Attest:*

HARRY F. MANBECK, JR.

*Attesting Officer*

*Commissioner of Patents and Trademarks*